US011613037B2

(12) United States Patent
Niehoff et al.

(10) Patent No.: US 11,613,037 B2
(45) Date of Patent: Mar. 28, 2023

(54) CUTTING UNIT FOR A LABELING DEVICE, AND LABELING DEVICE HAVING SUCH A CUTTING UNIT

(71) Applicant: KHS GmbH, Dortmund (DE)

(72) Inventors: Patrick Niehoff, Bochum (DE); Gerhard Klöpper, Hamburg (DE); Lutz Deckert, Haltern Am See (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 17/288,201

(22) PCT Filed: Nov. 4, 2019

(86) PCT No.: PCT/EP2019/080094

§ 371 (c)(1),
(2) Date: Apr. 23, 2021

(87) PCT Pub. No.: WO2020/094565

PCT Pub. Date: May 14, 2020

(65) Prior Publication Data

US 2021/0402634 A1 Dec. 30, 2021

(30) Foreign Application Priority Data

Nov. 8, 2018 (DE) ..... 10 2018 127 852.7

(51) Int. Cl.
*B26D 1/40* (2006.01)
*B26D 7/26* (2006.01)
(Continued)

(52) U.S. Cl.
CPC ..... *B26D 1/405* (2013.01); *B26D 7/2628* (2013.01); *B65C 9/1819* (2013.01); *B26D 2001/0066* (2013.01); *B65C 2009/1861* (2013.01)

(58) Field of Classification Search
CPC ..... B26D 1/405; B26D 1/40; B26D 7/2628; B26D 7/26; B26D 2001/0066; B26D 1/00;
(Continued)

(56) References Cited

U.S. PATENT DOCUMENTS 2,393,501 A * 1/1946 Brown ..... F16C 11/0614 403/132
2,782,853 A * 2/1957 Heffelfinger ..... B26D 1/385 83/350
(Continued)

FOREIGN PATENT DOCUMENTS

DE 39822238 T2 4/2005
DE 102006051359 A1 4/2008
(Continued)

*Primary Examiner* — Nhat Chieu Q Do
(74) *Attorney, Agent, or Firm* — Occhiuti & Rohlicek LLP

(57) ABSTRACT

A cutting unit comprising a cutting drum, a drum knife, a counterpart knife, and a double-joint controller that controls swiveling about a first joint, which swivels the counterpart knife between a cutting position and a waiting position, and swiveling about a second joint, which permits adjustment of a knife gap that forms between the counterpart knife and the drum knife in the cutting position. The drum knife is disposed on a circumference of the drum such that rotation of the drum guides the drum knife past the counterpart knife to cut a label when the counterpart knife is in the cutting position. In the waiting position, the counterpart knife is out of active engagement with the drum knife. The second joint permits adjustment of the knife gap such that the knife gap remains adjusted independently of swiveling about the first joint.

19 Claims, 5 Drawing Sheets

(51) Int. Cl.
*B65C 9/18* (2006.01)
*B26D 1/00* (2006.01)

(58) Field of Classification Search
CPC .. B65C 9/1819; B65C 9/18; B65C 2009/1861
USPC ..... 83/321
See application file for complete search history.

(56) References Cited

U.S. PATENT DOCUMENTS

| | | | | | |
|---|---|---|---|---|---|
| 4,355,554 | A | * | 10/1982 | Gregory, III | B26D 7/265 83/72 |
| 5,174,182 | A | * | 12/1992 | Rosenthal | B26D 7/28 83/823 |
| 5,240,755 | A | * | 8/1993 | Zimmer | B26F 1/18 206/820 |
| 5,863,382 | A | | 1/1999 | Hinton | |
| 9,289,911 | B2 | | 3/2016 | Andreato et al. | |
| 2006/0266179 | A1 | * | 11/2006 | Yamashita | B26D 7/2628 83/130 |
| 2012/0216663 | A1 | | 8/2012 | Carmichael | |
| 2019/0161312 | A1 | * | 5/2019 | Meyerhans | B41F 19/008 |

FOREIGN PATENT DOCUMENTS

| | | | | | |
|---|---|---|---|---|---|
| EP | 1052209 | A1 | | 11/2000 | |
| EP | 3243614 | A1 | * | 11/2017 | B26D 1/385 |
| EP | 3243614 | A1 | | 11/2017 | |
| GB | 1230476 | | * | 11/1968 | |
| WO | 9710953 | A1 | | 3/1997 | |

* cited by examiner

CUTTING UNIT FOR A LABELING DEVICE, AND LABELING DEVICE HAVING SUCH A CUTTING UNIT

RELATED APPLICATIONS

This is the national stage of international application PCT/EP2019/080094, filed on Nov. 4, 2019, which claims the benefit of the Nov. 8, 2018 priority date of German application DE 102018127852.7, the contents of which are incorporated herein by reference.

FIELD OF INVENTION

The invention relates to container processing, and in particular, to labeling containers.

BACKGROUND

Labeling machines for labeling containers typically have a cutting unit in which two knives cooperate to cut a length of material from a strip. This length is then transferred to a container.

At the point where cutting occurs, the label is in a knife gap between the two knives. The knife gap should be as small as possible to make a clean cut. But it should not be so small that the knives may collide. When the label is made of a very thin material, there is little margin for error. It is therefore important that this knife gap have the correct extent.

Moreover, during operation, there may be gaps in the container flow. It is therefore useful that no label be cut when such a gap occurs.

SUMMARY

An object of the invention is that of providing a cutting unit for a labelling device that permits fine adjustment of a knife gap between two knives and that allows the knives to switch between cutting a label and bypassing the cutting of a label so as to accommodate gaps in container flow.

In one aspect, the invention features a cutting unit that is to be provided for a labelling device of a labelling machine. The cutting unit comprises a cutting drum that can be driven such as to rotate about a drum axis. A cutting drum knife is provided at a drum circumference. The cutting drum knife is guided past a counterpart knife, which is provided at a switching-and-setting apparatus. The counterpart knife can be swiveled in a controlled manner between a cutting position and a waiting position in such a way that the counterpart knife in the cutting position is in active engagement with the rotating cutting drum knife, and in the waiting, position is out of engagement. Accordingly, by means of a second joint portion formed at the switching-and-setting apparatus, the knife gap formed in the cutting position between the cutting drum knife and the counterpart knife can be adjusted independently of the controlled swiveling motion of the first joint portion. Particularly advantageously, it is therefore possible for both the counterpart knife to be brought out of operational engagement with the cutting drum knife, as well as for the knife gap to be adjusted. Inasmuch as two joint portions are formed for this purpose at the switching-and-setting apparatus, both functional procedures can be adjusted independently of one another.

In some embodiments, provision can be made for the switching-and-setting apparatus to be configured in such a way for the first joint portion to be swiveled between the cutting position and the waiting position in such a way that, in the event of isolated gaps occurring in the bottle flow of the labelling device, then, at least for this one non-occupied container treatment position at the rotor, no label will be cut.

In some embodiments, provision can be made for the switching-and-setting apparatus to comprise a solid body joint, by means of which (solid body joint) the two joint sections are realized. It is therefore possible for both the first and second joint sections to be formed with a solid body joint. In other words, the solid body joint comprises the first and second joint section in the form of a doubled solid body joint. The solid body joint is therefore configured as a doubled solid body joint with the first and second joint sections. Provision can therefore be made for the solid body joint to be configured as a doubled solid body joint, with which the first and second joint sections are produced exclusively with the solid body joint. The first and second joint portions can advantageously be configured as being of one piece, in particular as one component with the solid body joint. The first and/or second joint portions of the solid body joint can be provided in the form of a removal of material, for example in the form of a tapering of material and/or curving at the solid body joint. Advantageously, the doubled solid body joint can therefore be designed as elastically deformable in the regions of its first and second joint portions. For example, the solid body joint can be provided as an essentially U-profile or C-profile solid body joint. By configuring the solid body joint in the form of a doubled solid body joint, joint sections can be provided at the switching-and-setting apparatus which are mechanically particularly easy to realize.

In some embodiments, provision can be made in this situation for the solid body joint to comprise a first side limb section, a second side limb section oriented essentially parallel to the first side limb section, and a base limb section connecting the two side limb sections at one free end.

In some embodiments, provision can be made in this situation for the first joint section to be formed at the solid body joint in the transition region between the first side limb section and the base limb section, and the second limb section in the transition region between the second limb section and the base limb section, and that the solid body joint is configured as elastically deformable at least in its respective joint section.

In some embodiments, provision can be made in this situation for the solid body joint to be configured as one part, in particular as one component.

In some embodiments, provision can be made in this situation for the switching-and-setting apparatus to be secured in a fixed position to the housing of the cutting mechanism by means of a holding element secured to the first side limb section.

In some embodiments, provision can be made in this situation for the switching-and-setting apparatus to comprise a switching lever element extending in an essentially L-shape, which, in order to initiate a swiveling motion between the cutting position and the waiting position onto the counterpart knife, is connected to a first side at the base limb section, and interacts directly or indirectly with a second side at the base limb section in such a way that, at the initiation of a setting movement by means of the switching apparatus, the switching lever element can be swiveled in a controlled manner about the first joint portion.

In some embodiments, provision can be made in this situation for the switching lever element to comprise a mechanical stop, in the region of its free end section of the second side, by means of which the deflection of the switching lever element between the waiting position and the cutting position can be adjusted.

In some embodiments, provision can be made in this situation for the cutting and setting apparatus to comprise a knife holder at its second side limb section of the solid body joint, at which the counterpart knife is held in such a way that, when a controlled swiveling motion takes place about the first joint portion, the counterpart knife is configured such as to swivel in a manner directly proportional to the deflection of the switching element lever.

In some embodiments, provision can be made in this situation for the relative positioning of the knife holder provided at the second side limb section to be capable of being fixed to the switching lever element in a secure position by means of a locking plate.

In some embodiments, provision can be made in this situation that, for the adjustment of the knife gap, the knife holder, including the counterpart knife held by it, is configured such that, by means of an adjustment device provided at the knife holder, it can swivel about the second joint portion relative to the switching lever element.

In some embodiments, provision can be made in this situation for the adjustment device to comprise a threaded spindle with a differential thread, wherein the threaded spindle provides along its shaft at least one first thread section and a second thread section, which both exhibit the same thread direction but with mutually differing thread pitches, wherein the first thread section of the threaded spindle, is engaged in a counter-thread of the knife holder, and the second thread section is engaged in a counter-thread of the switching lever element.

In another aspect, the invention features a cutting unit, the cutting unit comprising a cutting drum, a drum knife, a counterpart knife, and a double-joint controller that controls swiveling about a first joint, which swivels the counterpart knife between a cutting position and a waiting position, and swiveling about a second joint, which permits adjustment of a knife gap that forms between the counterpart knife and the drum knife in the cutting position, wherein the drum knife is disposed on a circumference of the drum such that rotation of the drum guides the drum knife past the counterpart knife to cut a label when the counterpart knife is in the cutting position, wherein, in the waiting position, the counterpart knife is out of active engagement with the drum knife, and wherein the second joint permits adjustment of the knife gap such that the knife gap remains adjusted independently of swiveling about the first joint.

The expression "essentially" or "approximately" signifies in the meaning of the invention deviations from the respective exact value by +/−10%, preferably by +/−5%, and/or deviations in the form of changes in shape which are not of significance for the function.

Further embodiments, advantages, and possible applications of the invention are also derived from the following description of exemplary embodiments and from the Figures. In this situation, all the features described and/or represented are in principle the object of the invention, whether individually or in any desired combination, regardless of their summary in the claims or reference to them. The contents of the claims are also deemed to be a component part of the description.

Although several aspects have been described in connection with a device, it is understood that these aspects also represent a description of the corresponding method, such that a block element or a structural element of a device is to be understood as also being a corresponding method step or as a feature of a method step. By analogy, aspects which have been described in connection with a method step or as a method step also represent a description of a corresponding block or detail or feature of a corresponding device. Some or all of the method steps can be formed by means of a hardware apparatus (or with the use of a hardware apparatus), such as, for example, a microprocessor, a programmable computer, or an electronic circuit. In some exemplary embodiments, some or several of the most important method steps can be carried out by one such apparatus.

BRIEF DESCRIPTION OF THE DRAWINGS

The invention is explained in greater detail hereinafter on the basis of the figures and in relation to exemplary embodiments. The Figures show.

Identical reference numbers are used in the figures for elements which are the same or have the same effect. Moreover, for the sake of easier overview, only reference numbers are represented in the individual figures which are required for the description of the respective figure. The invention is also represented in the figures only as a schematic view in order to explain the mode of operation. In particular, the representations in the figures serve only to provide an explanation of the underlying principle of the invention. For reasons of easier overview, not all the constituent parts of the device have been represented in each case.

DETAILED DESCRIPTION

Figure 1:
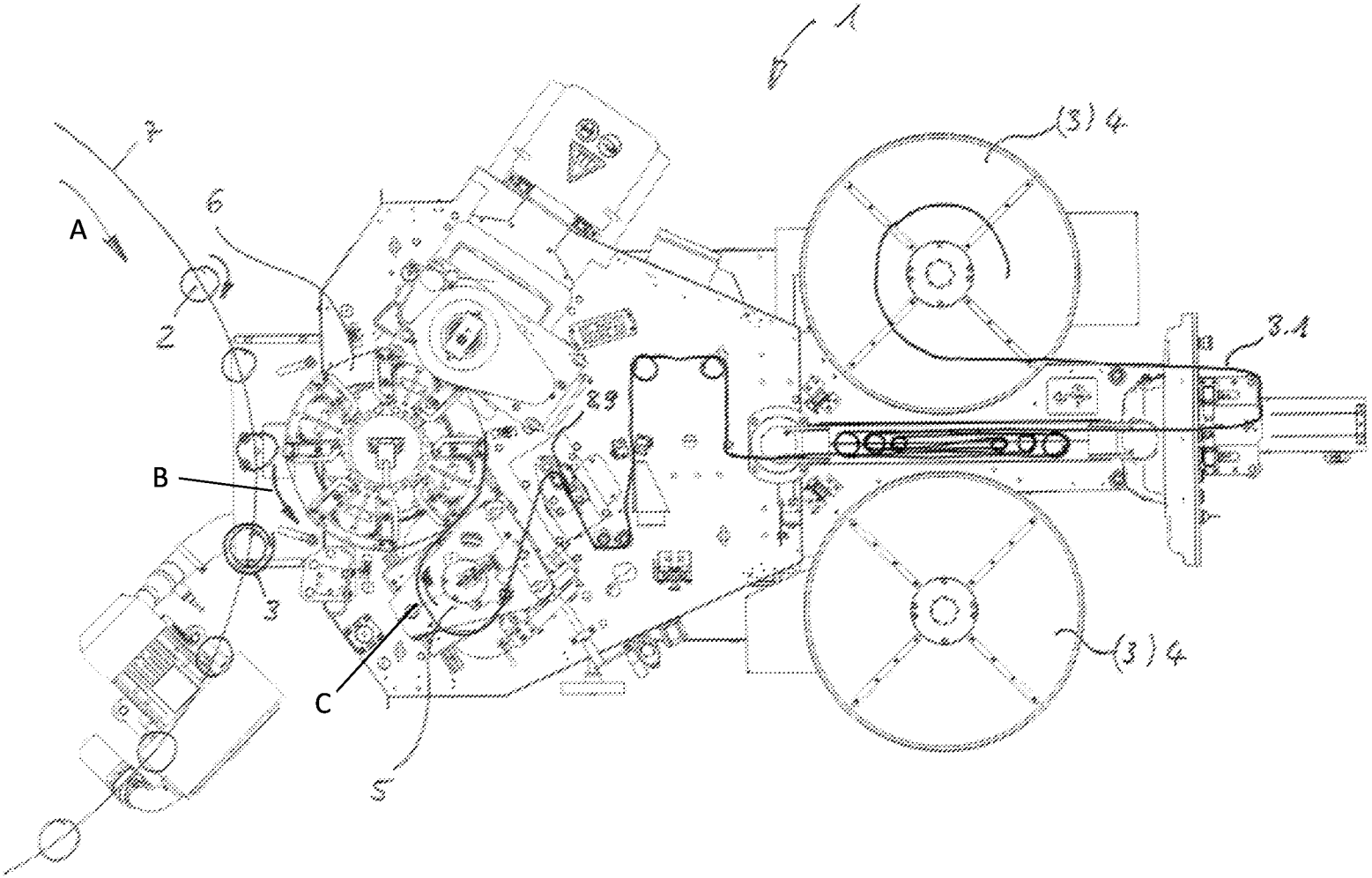
FIG. 1 shows a labeling machine.

FIG. 1 shows a labeling machine 1 for labeling containers 2 with roll-fed labels 3 that are drawn from a supply roll 4 of an endless strip 3.1. A cutting unit 5 cuts portions of the strip 3.1 to form a length required for a label 3. A drum 6 transfers such a label 3 to a container 2 as a rotor 7 conveys it past the labeling machine 1. The rotor rotates in a first direction A and the drum 6 rotates in a second direction B.

Rollers 8, 9 draw the strip 3.1 off the supply roll 4. They do so in synchrony with the rotor's rotation. The rollers 8, 9 convey the strip 3.1 to the cutting unit 5.

Figure 2:
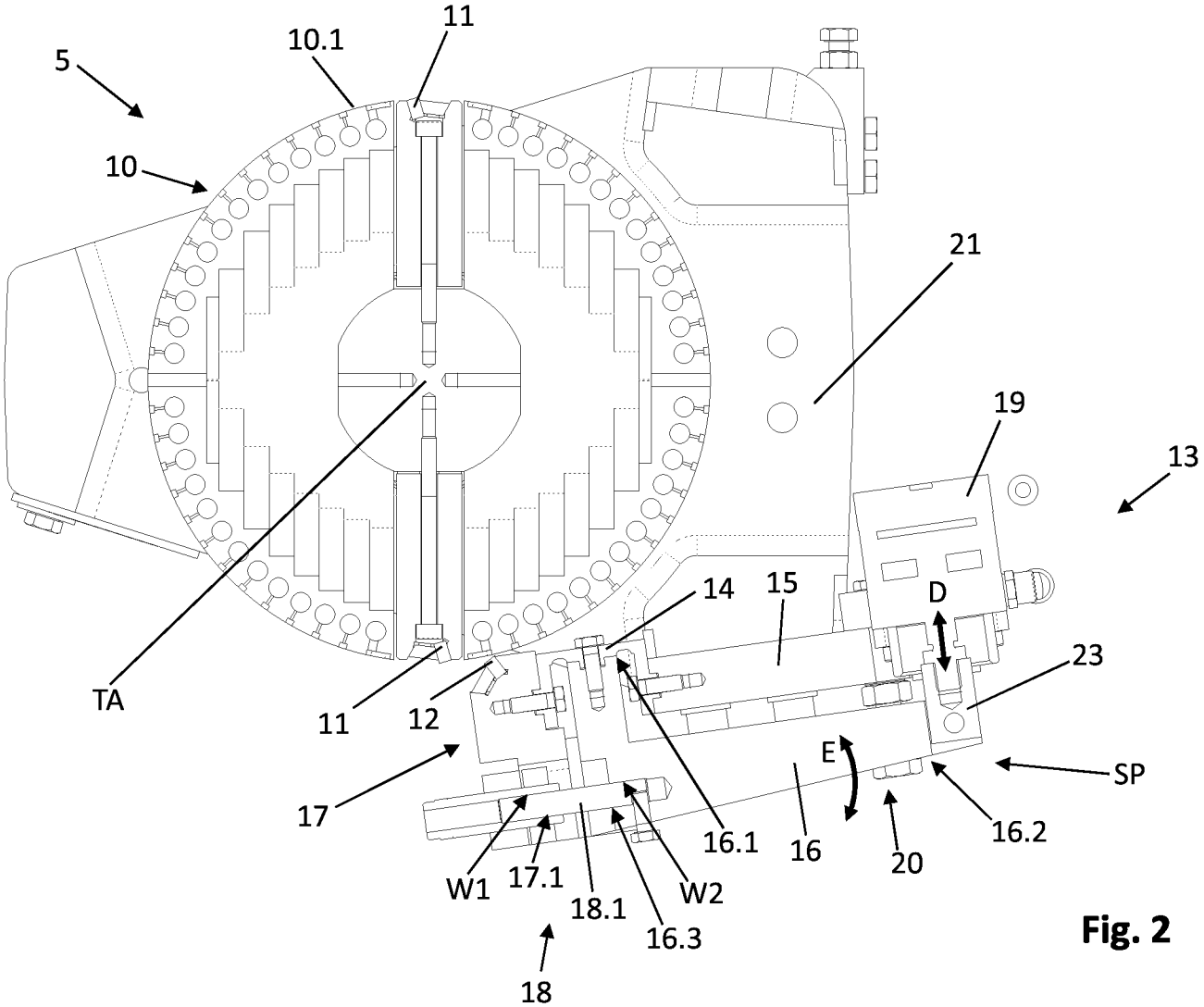
FIG. 2 shows part of a cutting unit from the labeling machine of FIG. 1.

Referring now to FIG. 2, the cutting unit 5 comprises a cutting drum 10 that rotates about its vertical drum axis TA in a third direction C that is opposite the second direction B.

Figure 3:
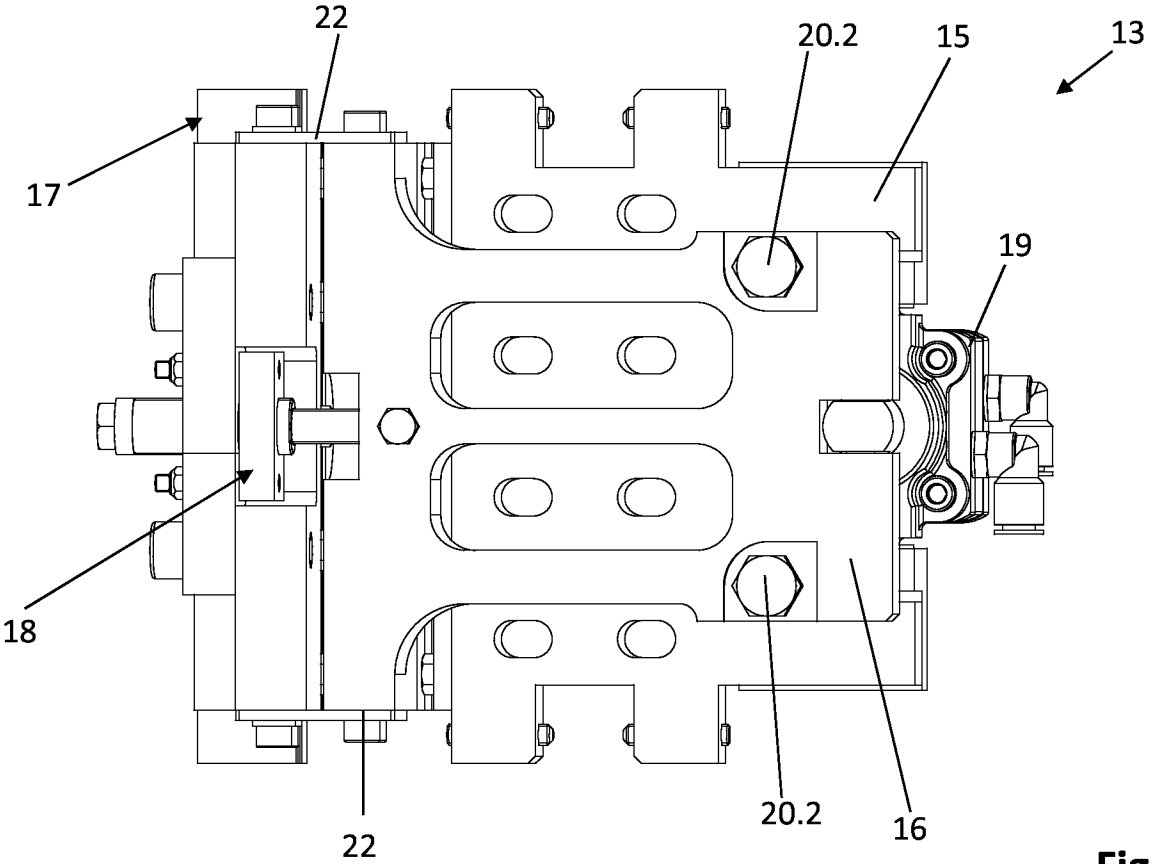
FIG. 3 shows the switching-and-setting apparatus, or double-joint controller from the cutting unit of FIG. 2.

A drum knife 11 on the drum's circumferential surface 10.1 is oriented with its blade extending along a direction that is parallel to the drum axis TA. As the drum 10 rotates, the drum knife 11 cooperates with a counterpart knife 12 to cut the strip 3.1 so as to form the label 3. The drum 10 holds the label at its circumferential surface 10.1, for example by a vacuum, and transfers it to the container 3. As a result, the cutting unit 5 can be said to have cut the label 3 by having the drum knife 11 be guided past the counterpart knife 12 that is held at a controller 13, which is shown in more detail in FIG. 3 and FIG. 4.

Figure 4:
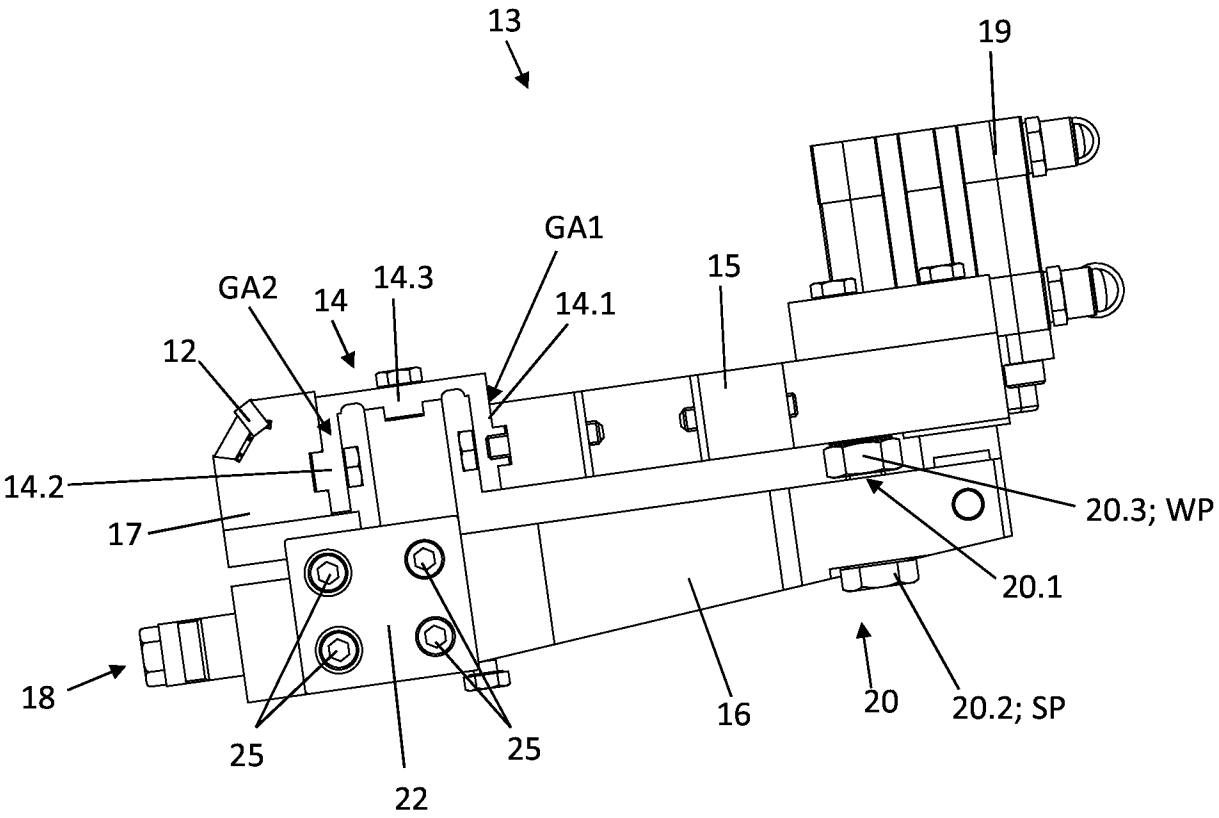
FIG. 4 shows the switching-and-setting apparatus of FIG. 3 from above.
Figure 5:
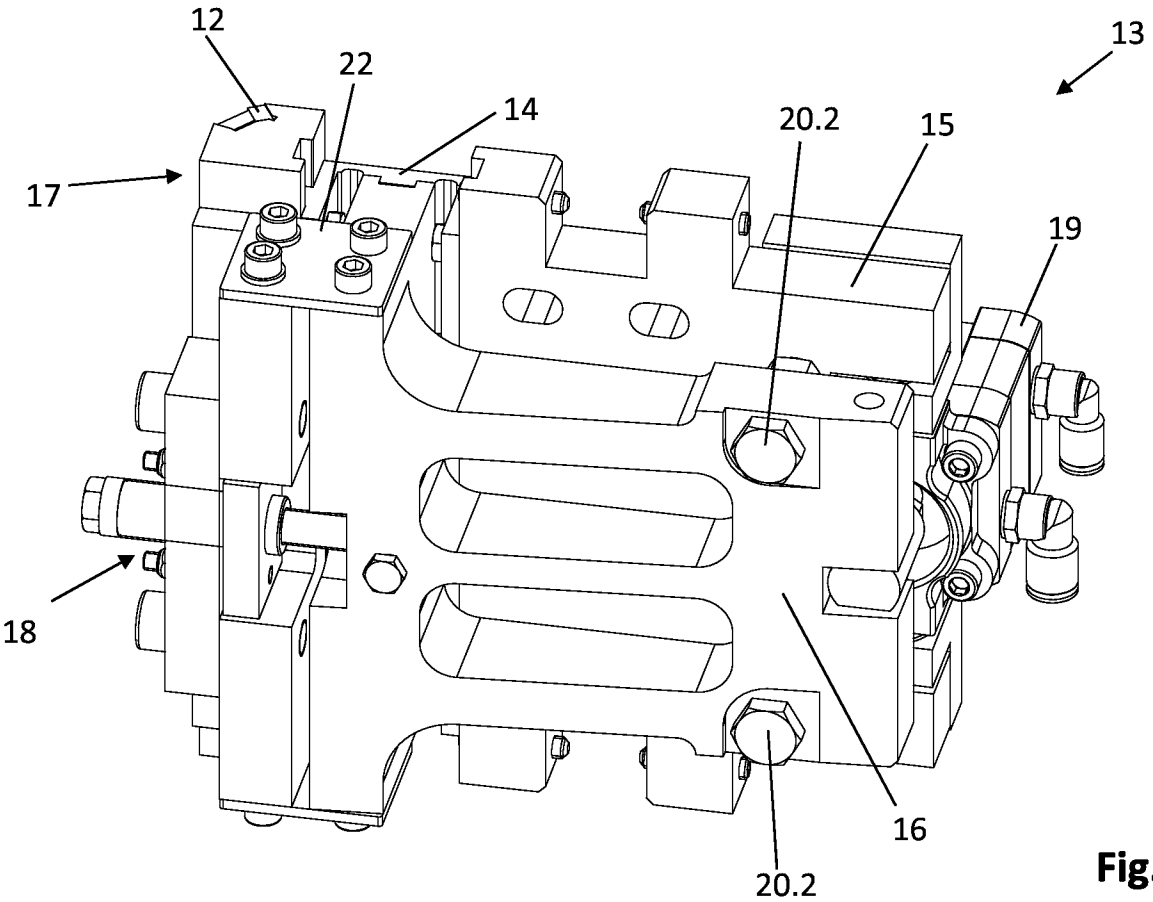
FIG. 5 is a perspective view of the switching-and-setting apparatus of FIG. 3.

As shown in FIG. 4, the controller 13 controls a first joint portion GA1 and a second joint portion GA2.

The first joint portion GA1 swivels the counterpart knife 12 between a cutting position SP and a waiting position WP.

The cutting position SP causes the counterpart knife 12 to engage the rotating drum knife 11 to cut labels 3. The waiting position WP causes the counterpart knife 12 to be disengaged from the drum knife 11. As a result, no labels 3 are cut.

When the counterpart knife 12 is in the cutting position SP, a knife gap exists between the between the drum knife 11 and the counterpart knife 12. The second joint portion GA2 adjusts this knife gap. The second joint portion GA2 does so independently of the first joint's controlled swiveling motion.

The controller 13 swivels the first joint portion GA1 between the cutting position SP and the waiting position WP in a controlled manner in response to isolated gaps occurring in the container flow. This avoids cutting a label 3 when, as a result of such a gap, there will be nothing to label.

As shown in FIG. 2, a holding plate 15 holds the controller 13 next to a housing 21 of the cutting unit 5. In a preferred embodiment, the holding plate 15 is screwed into the housing 21 so that it can be detached therefrom. The holding plate 15 holds various components of the controller 13.

Among these components is a switch 19 that swivels the first joint portion GA1 between the cutting position SP and the waiting position WP. The switch 19 preferably relies on a pneumatic cylinder apparatus that provides movement along a movement direction "D." This movement results in a swiveling motion.

As can be seen in FIG. 4, a joint 14 has first and second joint portions GA1, GA2. In some embodiments, the joint is formed from a single piece. Embodiments include those in which either the first joint portion GA1 or the second joint portion GA2 is formed by removal of material to create a taper or curve. In other embodiments, the joint 14 is elastically deformable in the regions at which it forms part of the first and second joint portions GA1, GA2. In other embodiments, the joint 14 has a U-shaped or C-shaped profile.

The particular embodiment shown in FIG. 4 has a U-shaped joint 14 provided at the holding plate 15 at an end thereof that is distal from the switch 19. The joint 14 has first and second side limbs 14.1, 14.2 and a base limb 14.3 that connects the side limbs 14.1, 14.2. The base limb 14.3 extends perpendicular to the parallel first and second side limbs 14.1, 14.2.

The first limb 14.1 connects the joint 14 to the holding plate 15, for example by being screwed to it so as to be detachable. The first joint portion GA1 is formed at the joint 14 in a transition region between the first side limb 14.1 and the base limb 14.3. The second joint portion GA2 is formed in a transition region between the second limb 14.2 and the base limb 14.3. The joint 14 returns to its original form after being deformed at the first and second joint portions GA1, GA2. In some embodiments, the joint 14 is formed from an elastic material. In other embodiments, the joint 14 is made from a single piece of metal that includes the first and second side limbs 14.1, 14.2 and the base limb 14.3.

Referring back to FIG. 2, the controller 13 includes a switching lever 16 that initiates swiveling motion between the cutting and waiting positions SP, WP. As seen from above, the switching lever 16 has first and second sides 16.1, 16.2 that form an L-shaped structure, with the first side 16.1 being the shorter of the two sides.

The first side 16.1 connects to the base limb 14.3. The second side 16.2 connects to a receiver 23 that moves in response to actuation of the switch 19. This movement causes swiveling at the first joint portion GA1 in a swiveling direction "E".

As shown in both FIG. 2 and FIG. 4, the switching lever 16 comprises a stop 20. The stop 20, which is a mechanical stop located at a free end of the second side 16.2, permits adjustment of the extent to which the switching lever 16 can deflect. This provides a way to adjust the stroke between the waiting position WP and the cutting position SP.

In some embodiments, a threaded spindle 20.1 with first and second nuts 20.2, 20.3 at ends thereof forms the stop 20. The first nut 20.2, which is the furthest from the holding plate 15, controls the lever's maximum deflection. At this maximum deflection, the counterpart knife 12 is at its cutting position SP in which it engages the drum knife 11 to cut labels 3. The second nut 20.3 which is closest to the holding plate 15, controls the placement of the lever 16 at the waiting position WP. As a result, it is possible to adjust the position of the lever 16 at the waiting position WP and at the cutting position SP along a continuum of values by turning the first and second nuts 20.2, 20.3.

The second limb 14.2 connects to a knife holder 17 into which the counterpoint knife 12 can be inserted and from which the counterpoint knife 12 is removed for replacement. In a preferred embodiment, the knife holder 17 is arranged at the second side limb 14.2 in a detachable but secure manner, preferably screwed to an outer side of the second side limb 14.2 opposite the switching lever 16. A locking plate 22 screwed to the switching lever 16 and to the knife holder 17 by screws 25 provides a secure coupling so that motion of the switching lever 16 results in motion of the knife holder 17.

The counterpoint knife 12 extends almost parallel to the drum axis TA. In a preferred embodiment, the counterpoint knife 12 makes an angle of about 0.15° relative to the drum axis TA. The knife holder 17 and the counterpoint knife 12 that it holds, swivels about the first joint portion GA1 between the cutting position SP and the waiting position WP by an amount that depends on the deflection of the switching lever 16.

The second joint portion GA2 provides a way to control the knife gap formed in the cutting position SP independently of the controlled swiveling motion of the first joint portion GA1. This is achieved by an adjustment device 18 that enables the knife holder 17 to be swiveled about the second joint portion GA2, which is formed between the second side limb 14.2 and the base limb 14.3. This swiveling motion is independent of that about the first joint portion GA1.

The adjustment device 18 absorbs forces in both directions of the swiveling motion about the second joint portion GA2. As shown in FIG. 2, the adjustment device 18 comprises a spindle 18.1 with a differential thread. The spindle's shaft has first and second threaded sections W1, W2 with the same thread direction but different pitches. The first threaded section W1 engages a counter-thread 17.1 of the knife holder 17. The second threaded section W2 engages a counter-thread 16.3 of the switching lever 16.

In the illustrated embodiment, the first threaded section W1 has a greater thread pitch than that of the second threaded section W2. When tightening of the spindle 18.1, the first threaded section W1 of the spindle 18.1, which has the greater thread pitch, slides in the counter-thread 17.1 of the knife holder 17. At the same time, however, the second threaded section W2, with its smaller pitch, moves in the counter-thread 16.3 of the switching lever element 16. Since the same rotation of the threaded spindle 18.1 translates into different displacements, tension arises between the first and second threaded sections W1, W2.

Adjustment of the knife gap using the adjustment device 18 takes place with the locking plate 22 unscrewed. After adjustment of the knife gap, the locking plate 22 is screwed back into position onto the switching lever 16 to fix the knife holder 17 in position.

The invention has been described heretofore by way of exemplary embodiments. It is understood that numerous modifications and derivations are possible without thereby departing from the underlying inventive concept.

The claims are deemed to be a constituent part of the description.

The invention claimed is:

1. An apparatus comprising:

a cutting unit and a controller that switches said cutting unit between cutting a portion of a moving strip and allowing said moving strip to remain uncut, said cutting unit comprising:

a single body joint that forms first and second joint portions, a cutting drum having a circumference, a counterpart knife, and a drum knife that is disposed on said circumference of said drum such that rotation of said drum guides said drum knife past said counterpart knife to cut off a length of said moving strip to form a label when said counterpart knife is in a cutting position and to permit said moving strip to remain uncut when said counterpart knife is in a waiting position and out of active engagement with said drum knife, wherein said controller controls said first and second joint portions to cause said counterpart knife to transition between said cutting position and said waiting position and to permit adjustment of a knife gap that forms between said counterpart knife and said drum in said cutting position, said knife gap remaining adjusted independently of movement of said counterpart knife, and wherein said a single body joint comprises first and second side limbs and a base limb extending therebetween, wherein said first joint portion is formed at a transition between said first limb and said base limb, wherein said second joint portion is formed at a transition between said second limb and said base limb, and wherein said single body joint is elastically deformable at both said first and second joint portions.

2. The apparatus of claim 1, wherein said controller is configured to cause said counterpart knife to transition between said waiting position and said cutting position in response to isolated gaps occurring in a container flow.

3. The apparatus of claim 1, wherein said single body joint comprises said first and second side limbs being parallel and said base limb perpendicular to said side limbs and connecting said side limbs.

4. The apparatus of claim 1, further comprising a housing for said cutting unit and a holding plate that secures said controller to a fixed position on said housing.

5. The apparatus of claim 1, further comprising a switch, wherein said controller comprises an L-shaped switching lever that comprises a first side that connects to said joint and a second side that interacts with said switch and wherein movement of said switch causes movement of said switching lever to cause said counterpart knife to transition between said cutting position and said waiting position.

6. The apparatus of claim 1, further comprising a stop and a lever, said lever being a switching lever and said stop being a mechanical stop, wherein movement of said lever causes a transition between said waiting and cutting positions, wherein said stop is disposed at a free end of said lever, and wherein said stop is adjustable to adjust a stroke between said waiting and cutting positions.

7. The apparatus of claim 1, wherein said controller comprises a lever and a knife holder, wherein said joint comprises said first side limb, wherein said knife holder holds said counterpart knife such that said counterpart knife swivels about said first joint portion joint portion to an extent that is proportional to deflection of said lever.

8. The apparatus of claim 1, wherein said controller comprises a locking plate, a lever, and a knife holder, and a link, wherein said joint comprises said first side limb, wherein said knife holder is at said first side limb, and wherein said locking plate secures said first side limb to said lever.

9. The apparatus of claim 1, wherein said controller comprises a knife holder, a lever, and an adjustment device, wherein said knife holder holds said counterpart knife, wherein said adjustment device, which is at said knife holder, is configured to adjust said knife gap by swiveling about said second joint portion relative to said lever.

10. The apparatus of claim 1, further comprising first and second counter-threads and a threaded spindle, said threaded spindle having first and second threaded sections that are threaded in the same direction with different pitches, wherein said first threaded section engages said first counter-thread and said second threaded section engages said second counter-thread, wherein said first counter-thread is on a knife holder and said second counter-thread is on a switching lever.

11. The apparatus of claim 1, further comprising a labeling machine for labeling containers with labels from a roll-fed label, wherein said cutting unit is a constituent of said labeling machine.

12. The apparatus of claim 1, wherein said double joint controller causes swiveling about said first joint portion to cause said transition between said cutting position and said waiting position and wherein said controller causes swiveling about said second joint portion to permit said adjustment of said knife gap.

13. The apparatus of claim 1, wherein said single body joint is C-shaped.

14. The apparatus of claim 1, wherein said single body joint is U-shaped.

15. The apparatus of claim 1, further comprising a rotor, an additional drum, and first and second rollers, wherein said additional drum receives a label that has been cut by said cutting machine and that transfers said label to a container as said rotor conveys said label past a labeling machine, wherein said first and second rollers convey a strip drawn from a supply roll of roll-fed labels to said cutting unit.

16. The apparatus of claim 1, further comprising an additional drum that transfers a label that has been cut by said cutting unit to a container, wherein said additional drum rotates in a direction opposite to a direction in which said cutting drum rotates.

17. The apparatus of claim 1, wherein said cutting drum holds said a label at a circumferential surface thereof using a vacuum.

18. The apparatus of claim 1, further comprising a switch that pneumatically causes movement of a switching lever to cause said counterpart knife to transition between said cutting position and said waiting position.

19. The apparatus of claim 1, wherein said single body joint returns to its original form after having been deformed at said first and second joint portions thereof.

* * * * *